US011950674B2

(12) United States Patent
Topal et al.

(10) Patent No.: US 11,950,674 B2
(45) Date of Patent: Apr. 9, 2024

(54) HAIR TEASING AND DAMAGE REDUCTION SYSTEM AND METHOD

(71) Applicant: EZ PZ TEEZ, INC., South Daytona, FL (US)

(72) Inventors: Muzaffer Topal, Boca Raton, FL (US); Mesrop Varol, Palm Coast, FL (US)

(73) Assignee: EZ PZ TEEZ, INC., South Daytona, FL (US)

( * ) Notice: Subject to any disclaimer, the term of this patent is extended or adjusted under 35 U.S.C. 154(b) by 198 days.

(21) Appl. No.: 16/726,760

(22) Filed: Dec. 24, 2019

(65) Prior Publication Data

US 2021/0186173 A1 Jun. 24, 2021

(51) Int. Cl.

| | |
|---|---|
| ***A45D 7/02*** | (2006.01) |
| ***A45D 2/42*** | (2006.01) |
| ***A45D 7/00*** | (2006.01) |
| *A45D 2/00* | (2006.01) |

(52) U.S. Cl.

CPC ..... *A45D 2/42* (2013.01); *A45D 7/00* (2013.01); *A45D 2002/003* (2013.01)

(58) Field of Classification Search

CPC ..... A45D 2/42; A45D 2/18; A45D 2/2421; A45D 2/38; A45D 19/018; A45D 2/127; A45D 19/0024; A45D 19/028; A45D 19/016; A45D 19/0083; A45D 6/08; A45D 6/10; A45D 2006/005; A45D 8/24; A45D 20/00; A45D 7/045; A45D 7/065; A45D 8/20; A45D 2007/002

See application file for complete search history.

(56) References Cited

U.S. PATENT DOCUMENTS

| | | | | |
|---|---|---|---|---|
| 1,900,970 A * | 3/1933 | Alimena | A45D 8/14 | 24/564 |
| 3,543,771 A * | 12/1970 | Altman | A45D 2/127 | 132/222 |
| 3,608,565 A * | 9/1971 | Ensign | A45D 44/02 | 132/212 |
| 3,692,032 A * | 9/1972 | Regas | A45D 19/018 | 132/212 |
| 3,861,405 A * | 1/1975 | Pellecchia | A45D 19/018 | 132/270 |
| 5,156,172 A * | 10/1992 | Tancredi | A45D 19/018 | 132/270 |
| 5,771,906 A * | 6/1998 | De Benedictis | A45D 2/00 | 132/207 |
| 6,237,611 B1 * | 5/2001 | LeCrone | A42B 1/004 | 132/275 |

(Continued)

*Primary Examiner* — Rachel R Steitz
*Assistant Examiner* — Brianne E Kalach
(74) *Attorney, Agent, or Firm* — Seed IP Law Group LLP

(57) ABSTRACT

A hair teasing and damage reduction system is disclosed. The system includes a sleeve having a first half, a second half, and a middle connecting region. The first half of the sleeve includes a hair engaging surface and a non-contact surface with a pocket formed by a left lateral edge, a right lateral edge, and an end edge. The second half of the sleeve includes a hair engaging surface and a non-contact surface with a pocket formed by a left lateral edge, a right lateral edge, and an end edge. The pinch clip has a clasping end, a gripping end, and a hinge. The clasping end includes a top prong and a bottom prong. The gripping end includes a top extension and a bottom extension.

11 Claims, 17 Drawing Sheets

(56) References Cited

U.S. PATENT DOCUMENTS

| | | | | |
|---|---|---|---|---|
| 6,394,102 | B1 * | 5/2002 | Vogel | A45D 8/24 132/273 |
| 7,021,317 | B1 * | 4/2006 | Nathaniel | A45D 19/016 132/270 |
| RE40,462 | E * | 8/2008 | Vogel | A45D 8/24 132/273 |
| 8,256,438 | B2 * | 9/2012 | Tojo | A45D 19/012 132/270 |
| 2012/0260935 | A1 * | 10/2012 | Lalonde | A45D 8/24 132/273 |

* cited by examiner

HAIR TEASING AND DAMAGE REDUCTION SYSTEM AND METHOD

TECHNICAL FIELD

The present disclosure generally relates to a hair teasing and damage reduction system and method. More particularly, the present disclosure relates to a hair teasing and damage reduction system and method that reduces clumping and knotting, as well as protecting hair from other types of damage during a hair teasing process.

DESCRIPTION OF THE RELATED ART

For an extended period of time, people have endeavored to style and color their hair in a wide variety of different ways. Accordingly, while numerous ways exist to achieve various hair styles and colorings, many of these techniques have significant drawbacks and disadvantages. Such drawbacks and disadvantages of these legacy techniques include significant cost requirements, significant time requirements, damage to the hair, pain or unpleasantness to the subject, and less than satisfactory results.

For example, hair teasing, such as for use with foil or balayage procedures, can often result in damage to the hair, as well as clumps, knots, and tangles in the hair. Additionally, removing these clumps, knots, and tangles from the hair can cause pain to the subject of the procedure, as well as pulling out hair and further damaging the hair in other aspects. It would be desirable to find another way to tease hair without all of these significant drawbacks and disadvantages. There is a continuing need in the art for a hair styling and coloring techniques that are faster, more efficient, easy to perform, and less damaging to the hair.

Notably, not all of the subject matter discussed in this section is necessarily prior art and should not be assumed to be prior art merely as a result of its discussion in this section. Accordingly, any recognition of problems in the prior art discussed in this section or associated with such subject matter should not be treated as prior art unless expressly stated to be prior art. Instead, the discussion of any subject matter in this section should be treated as part of the identification of the technological problem to be overcome, which in and of itself may also be inventive.

BRIEF SUMMARY

A hair teasing and damage reduction system may be summarized as including a sleeve having a first half, a second half, and a middle connecting region. The first half of the sleeve includes a hair engaging surface and a non-contact surface with a pocket formed by a left lateral edge, a right lateral edge, and an end edge. The second half of the sleeve includes a hair engaging surface and a non-contact surface with a pocket formed by a left lateral edge, a right lateral edge, and an end edge. A pinch clip that holds hair in place has a clasping end, a gripping end, and a hinge. The clasping end includes a top prong and a bottom prong. The gripping end including a top extension and a bottom extension. The top prong and a bottom prong of the pinch clip are slidably insertable into the pocket of the first half of the sleeve and the pocket of the second half of the sleeve, and are slidably removable from the pocket of the first half of the sleeve and the pocket of the second half of the sleeve, thereby enabling the pinch clip to be housed partially within the sleeve to grip a slidably section of hair.

The left lateral edge may be stitched. The right lateral edge may be stitched. The end edge may be stitched. The pinch clip may be an Alligator Pinch Clip. The pinch clip may be a single pinch clip. The pinch clip may be a double pinch clip. The sleeve may be constructed of a material with sufficient flexibility to move in conjunction with the pinch clip. The pocket formed by the left lateral edge, right lateral edge, and end edge may house the clasping ends of the top prong and bottom prong. The pocket formed by the left lateral edge, right lateral edge, and end edge may house at least a portion of the clasping ends of the top prong and bottom prong. The hair engaging surfaces of the first and second halves of the sleeve may have a co-efficient of friction that grips and holds some, but not all, of hair that is positioned between the hair engaging surfaces when clamped by the pinch clip positioned in the pockets of the sleeves.

A hair teasing and damage reduction method may be summarized as including: providing a hair teasing system, the hair teasing system including a sleeve and a pinch clip, the sleeve having a first half, a second half, and a middle connecting region, wherein the first half of the sleeve includes a hair engaging surface and a non-contact surface with a first half pocket, and wherein the second half of the sleeve includes a hair engaging surface and a non-contact surface with a second half pocket, the pinch clip having a clasping end, a gripping end, and a hinge, the clasping end including a top prong and a bottom prong, and the gripping end including a top extension and a bottom extension; inserting the top prong of the pinch clip into the first half pocket of the sleeve and inserting the bottom prong of the pinch clip into the second half pocket of the sleeve; pinching the top extension and the bottom extension of the gripping end of the pinch clip together and separating the top prong of the pinch clip with the first half pocket of the sleeve from the bottom prong of the pinch clip with the second half pocket of the sleeve; placing the pinched pinch clip and covering sleeve over a section of hair to be teased on a user; releasing the pinched top extension and bottom extension of the gripping end of the pinch clip, which converges the top prong of the pinch clip within the first half pocket of the sleeve towards the bottom prong of the pinch clip within the second half pocket of the sleeve around the section of hair to be teased on the user; pushing the hair teasing system griping the section of hair to be teased towards the head of the user while holding the end of the section of hair to be teased, wherein the hair engaging surfaces of the first and second halves of the sleeve pushes some of the hair in the section of hair to be teased towards the head of the user while a remaining portion of the section of hair to be teased slides through the hair engaging surfaces of the first and second halves of the sleeve and is not pushed towards the head of the user; slidably removing the top prong of the pinch clip from the first half pocket of the sleeve and slidably removing the bottom prong of the pinch clip from the second half pocket of the sleeve, while maintaining the hair engaging surfaces of the first and second halves of the sleeves in contact with the section of hair to be teased; pinching the top extension and the bottom extension of the gripping end of the pinch clip together and separating the top prong of the pinch clip from the bottom prong of the pinch clip; and releasing the pinched top extension and bottom extension of the gripping end of the pinch clip, which converges the top prong of the pinch clip towards the bottom prong of the pinch clip around the section of hair to be teased on the user.

The pocket first half of the sleeve may be formed by a left lateral edge, a right lateral edge, and an end edge. The pocket second half of the sleeve may be formed by a left lateral edge, a right lateral edge, and an end edge.

A left lateral edge may be stitched. A right lateral edge may be stitched. An end edge may be stitched. The pinch clip may be an Alligator Pinch Clip. The sleeve may be constructed of a material with sufficient flexibility to move in conjunction with the pinch clip. The pocket formed by a left lateral edge, a right lateral edge, and an end edge may house the clasping ends of the top prong and bottom prong. The pocket formed by the left lateral edge, right lateral edge, and end edge may house at least a portion of the clasping ends of the top prong and bottom prong. The hair engaging surfaces of the first and second halves of the sleeve have a co-efficient of friction that grips and holds some, but not all, of hair that is positioned between the hair engaging surfaces when clamped by the pinch clip positioned in the pockets of the sleeves.

A hair teasing and damage reduction system may be summarized as including a sleeve having a first half, a second half, and a middle connecting region. The first half of the sleeve includes a hair engaging surface and a non-contact surface with a pocket formed by a left lateral edge, a right lateral edge, and an end edge. The second half of the sleeve includes a hair engaging surface and a non-contact surface with a pocket formed by a left lateral edge, a right lateral edge, and an end edge.

A top prong and a bottom prong of a pinch clip are slidably insertable into the pocket of the first half of the sleeve and pocket of the second half of the sleeve, and slidably removable from the pocket of the first half of the sleeve and pocket of the second half of the sleeve, thereby enabling the pinch clip to be housed partially within the sleeve to grip a slidably section of hair.

BRIEF DESCRIPTION OF THE SEVERAL VIEWS OF THE DRAWINGS

The present disclosure will be more fully understood by reference to the following figures, which are for illustrative purposes only. These non-limiting and non-exhaustive embodiments are described with reference to the following drawings, wherein like labels refer to like parts throughout the various views unless otherwise specified. The sizes and relative positions of elements in the drawings are not necessarily drawn to scale. For example, the shapes of various elements are selected, enlarged, and positioned to improve drawing legibility. The particular shapes of the elements as drawn have been selected for ease of recognition in the drawings. The figures do not describe every aspect of the teachings disclosed herein and do not limit the scope of the claims.

DETAILED DESCRIPTION

Persons of ordinary skill in the art will understand that the present disclosure is illustrative only and not in any way limiting. Other embodiments of the presently disclosed system and method readily suggest themselves to such skilled persons having the assistance of this disclosure.

Each of the features and teachings disclosed herein can be utilized separately or in conjunction with other features and teachings to provide a hair teasing and damage reduction system and method. Representative examples utilizing many of these additional features and teachings, both separately and in combination, are described in further detail with reference to attached FIGS. 1-12E. This detailed description is merely intended to teach a person of skill in the art further details for practicing aspects of the present teachings and is not intended to limit the scope of the claims. Therefore, combinations of features disclosed above in the detailed description may not be necessary to practice the teachings in the broadest sense, and are instead taught merely to describe particularly representative examples of the present teachings.

In the description below, for purposes of explanation only, specific nomenclature is set forth to provide a thorough understanding of the present system and method. However, it will be apparent to one skilled in the art that these specific details are not required to practice the teachings of the present system and method.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples.

Figure 1A:
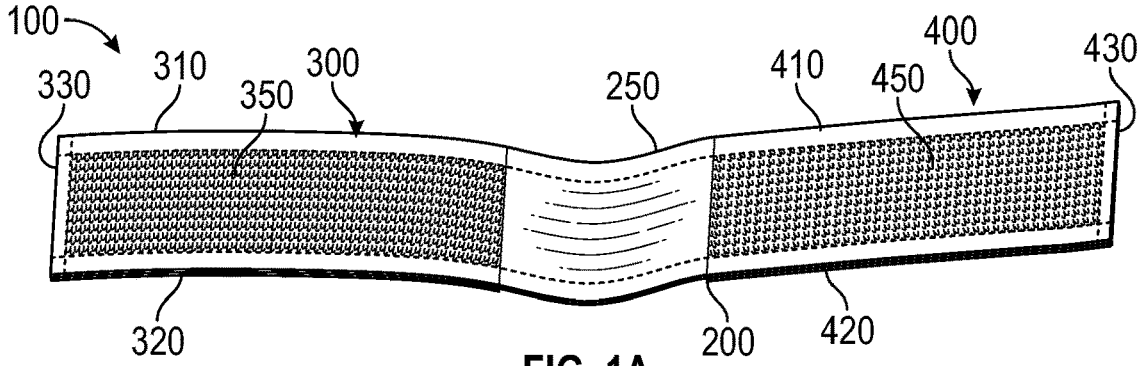
FIG. 1A is a bottom perspective view of an open sleeve portion of one exemplary embodiment of a hair teasing and damage reduction system and method.
Figure 1B:
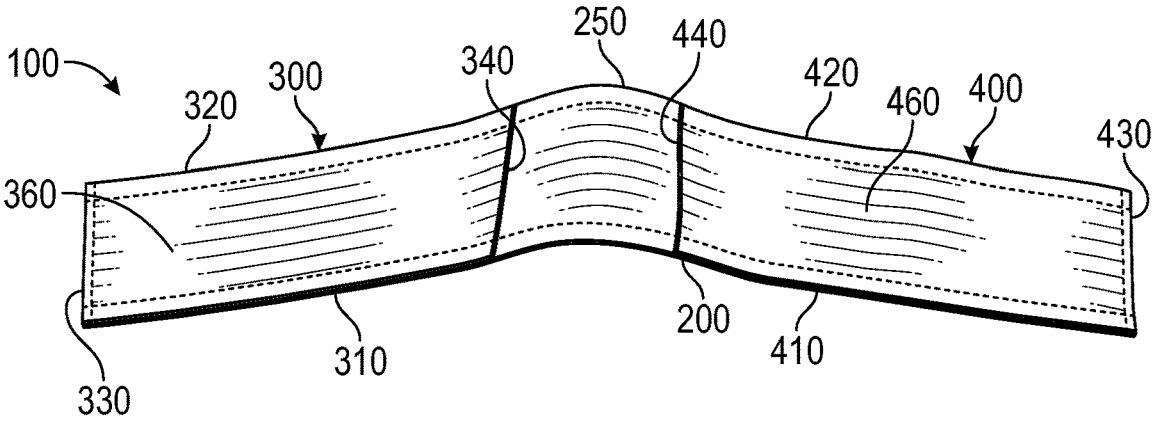
FIG. 1B is a top perspective view of an open sleeve portion of one exemplary embodiment of a hair teasing and damage reduction system and method.
Figure 1C:
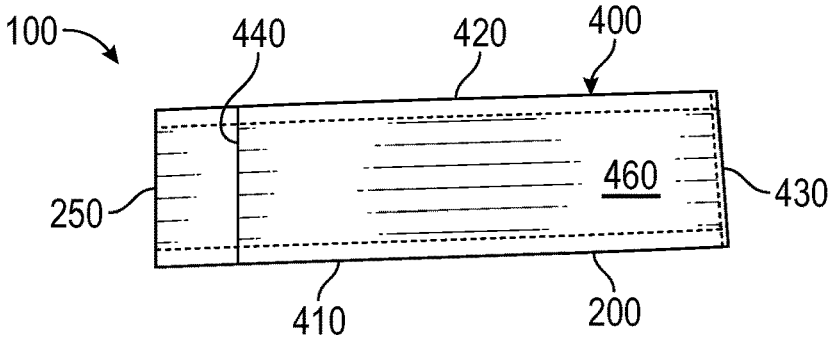
FIG. 1C is a top view of a closed sleeve portion of one exemplary embodiment of a hair teasing and damage reduction system and method.
Figure 1D:
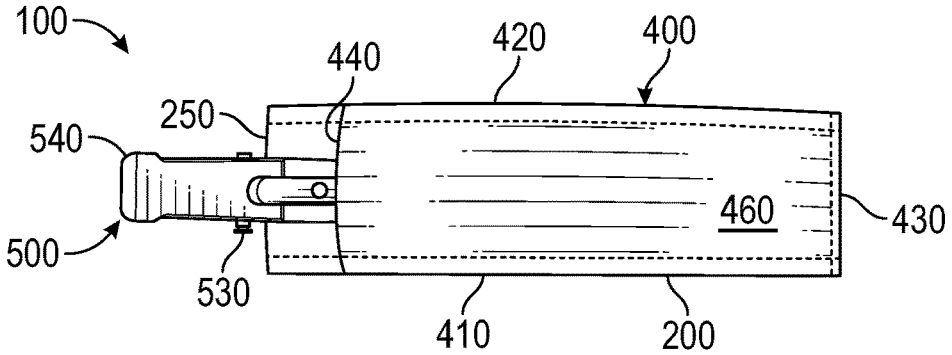
FIG. 1D is a top view of a closed sleeve portion of one exemplary embodiment of a hair teasing and damage reduction system and method, with the pinch clip inserted into a pocket of the closed sleeve portion.
Figure 2A:
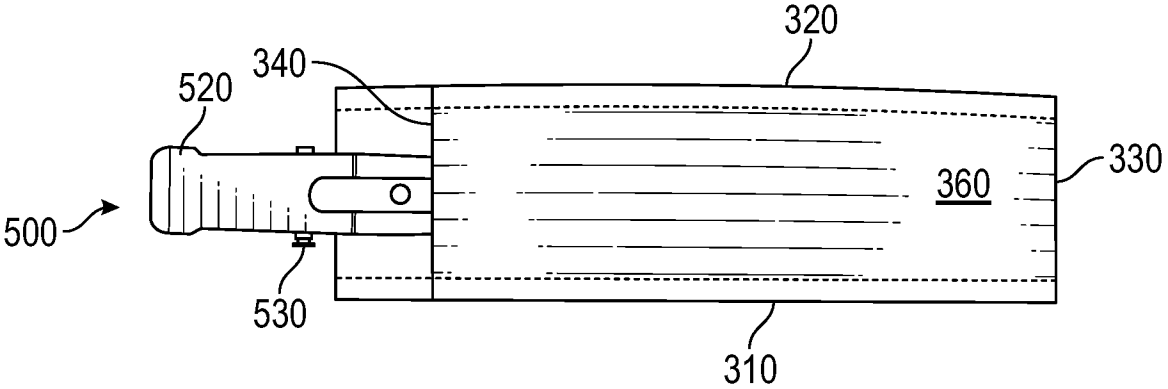
FIG. 2A is a bottom view of a closed sleeve portion of one exemplary embodiment of a hair teasing and damage reduction system and method, with the pinch clip inserted into a pocket of the closed sleeve portion.
Figure 2C:
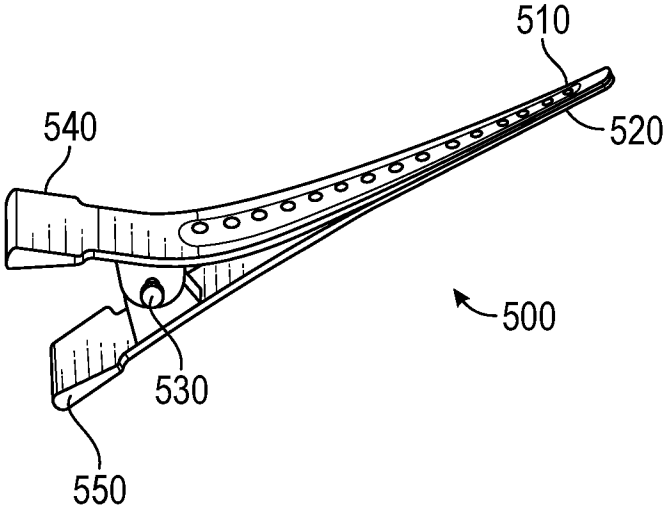
FIG. 2C is a top perspective view of a pinch clip of one exemplary embodiment of a hair teasing and damage reduction system and method.
Figure 2B:
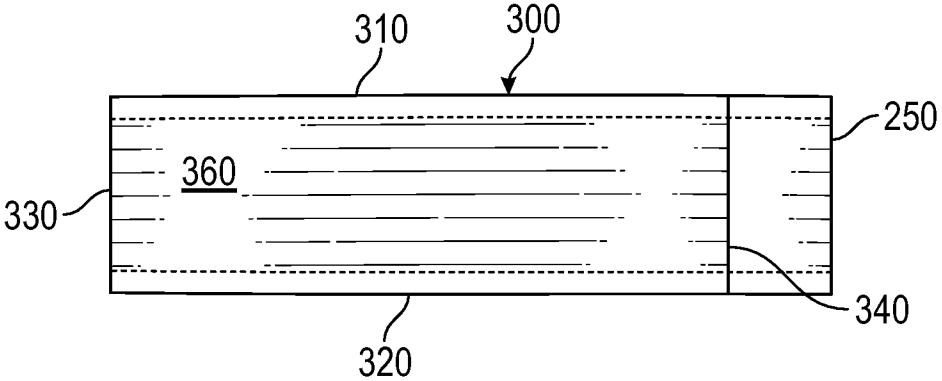
FIG. 2B is a bottom view of a closed sleeve portion of one exemplary embodiment of a hair teasing and damage reduction system and method.

Referring now to FIGS. 1A and 1B, in one or more embodiments a hair teasing and damage reduction system and method 100 is disclosed that is faster, more efficient, easy to perform, and less damaging to the hair than traditional hair teasing techniques, such as back combing. Thus, not only is the hair teasing and damage reduction system and method 100 dramatically faster than conventional hair teasing techniques, it is also far less damaging to the hair. While any hair teasing application involves at least minor stripping of the hair, the hair teasing and damage reduction system and method 100 causes only minor damage to the recipient's hair (e.g., 1-3 on a scale of 1 to 10 with 1 being minor and 10 severe), while traditional hair teasing techniques, such as back combing may cause more severe damage to the recipient's hair (e.g., 7-9 on a scale of 1 to 10 with 1 being minor and 10 severe).

In some embodiments, the hair teasing and damage reduction system and method 100 includes a sleeve 200 and a pinch clip 500. In some embodiments, the sleeve 200 is dual ended and has a middle connecting region 250. Such a dual ended sleeve 200 has a first half 300 and a second half 400 that are linked by the middle connecting region 250. In one or more implementations of the hair teasing and damage reduction system and method 100, the first half 300 of the sleeve 200 includes left lateral edge 310, a right lateral edge 320, and an end edge 330. The left lateral edge 310, right lateral edge 320, and end edge 330 together form a pocket 340 into which a portion the pinch clip 500 is housed. In some embodiments, all of the left lateral edge 310, right lateral edge 320, and end edge 330 are sealed closed by stitching, adhesive, or other suitable method. In other embodiments, one of more of the left lateral edge 310, right lateral edge 320, and end edge 330 are not sealed, but rather are left open, so that a pinch clip 500 with a larger dimension than the pocket 340 may still be accommodated by the sleeve 200. In such a combination, a portion of the pinch clip 500 extends beyond one or more of the left lateral edge 310, right lateral edge 320, and end edge 330.

In another aspect of an embodiment of the hair teasing and damage reduction system and method 100, the first half 300 of the sleeve 200 has a hair engaging surface 350 and a non-contact surface 360. The hair engaging surface 350 of the first half 300 of the sleeve 200 has a textured surface that grips at least some of a subject's hair when the hair engaging surface 350 is pushed against a section of hair and then moved in sliding contact along the section of hair towards the roots of the hair in the section. In some preferred embodiments, the textured surface of the hair engaging surface 350 of the first half 300 of the sleeve 200 is the "hook" side of a "hook and loop" fastener (e.g., Velcro). In other embodiments, the textured surface of the hair engaging surface 350 of the first half 300 of the sleeve 200 may be other rough or coarse surfaces (e.g., ribs, pointed bumps, rounded bumps, flat-topped bumps, and the like) of a rubber, plastic, or other appropriate material that has a coefficient of friction sufficiently high enough to grip at least some of a section of hair when in sliding contact with the section of hair. In some embodiments, the non-contact surface 360 of the first half 300 of the sleeve 200 may be of any texture, since this non-contact surface 360 of the first half 300 of the sleeve 200 is not designed to make gripping contact with the subject's hair.

In one or more implementations of the hair teasing and damage reduction system and method 100, the second half 400 of the sleeve 200 includes a left lateral edge 410, a right lateral edge 420, and an end edge 430. The left lateral edge 410, right lateral edge 420, and end edge 430 together form a pocket 440 into which a portion the pinch clip 500 is housed. In some embodiments, all of the left lateral edge 410, right lateral edge 420, and end edge 430 are sealed closed by stitching, adhesive, or other suitable method. In other embodiments, one of more of the left lateral edge 410, right lateral edge 420, and end edge 430 are not sealed, but rather are left open, so that a pinch clip 500 with a larger dimension than the pocket 440 may still be accommodated by the sleeve 200. In such a combination, a portion of the pinch clip 500 extends beyond one or more of the left lateral edge 410, right lateral edge 420, and end edge 430.

In another aspect of an embodiment of the hair teasing and damage reduction system and method 100, the second half 400 of the sleeve 200 has a hair engaging surface 450 and a non-contact surface 460. The hair engaging surface 450 of the second half 400 of the sleeve 200 has a textured surface that grips at least some of a subject's hair when the hair engaging surface 450 is pushed against a section of hair and then moved in sliding contact along the section of hair towards the roots of the hair in the section. In some preferred embodiments, the textured surface of the hair engaging surface 350 of the second half 400 of the sleeve 200 is the "hook" side of a "hook and loop" fastener (e.g., Velcro). In other embodiments, the textured surface of the hair engaging surface 450 of the second half 400 of the sleeve 200 may be other rough or coarse surfaces (e.g., ribs, pointed bumps, rounded bumps, flat-topped bumps, and the like) of a rubber, plastic, or other appropriate material that has a coefficient of friction of a sufficiently high enough to grip at least some of a section of hair when in sliding contact with the section of hair. In some embodiments, the non-contact surface 460 of the second half 400 of the sleeve 200 may be of any texture, since this non-contact surface 460 of the second half 400 of the sleeve 200 is not designed to make gripping contact with the subject's hair.

In other embodiments the hair teasing and damage reduction system and method 100 includes a two-piece sleeve and a pinch clip 500, in which the two-piece sleeve includes a first end piece and a second end piece without a connecting middle piece. In such an embodiment, the first end piece of the hair teasing and damage reduction system and method 100 still contains a left lateral edge 310, a right lateral edge 320, and an end edge 330 that together form a pocket 340 into which a portion the pinch clip 500 is housed. Additionally, the second end piece of the hair teasing and damage reduction system and method 100 also still contains a left lateral edge 410, a right lateral edge 420, and an end edge 430 that together form a pocket 440 into which a portion the pinch clip 500 is housed. Furthermore, in some embodiments, the first end piece of the two-piece sleeve has a hair engaging surface 350 and a non-contact surface 360, and the second end piece of the two-piece sleeve has a hair engaging surface 450 and a non-contact surface 460.

Referring now to FIGS. 1D, 2A, 2B, and 2C, another aspect of the hair teasing and damage reduction system and method 100 includes the pinch clip 500. In one or more embodiments, the pinch clip 500 is an Alligator style pinch clip 500. Additionally, in some embodiments, the pinch clip 500 is a single pinch clip 500. In other embodiments, the pinch clip 500 is a double pinch clip 500. In still other embodiments, other type of barrettes or clasps are employed as the pinch clip 500 for holding a subject's hair in place. In one or more embodiments of the hair teasing and damage reduction system and method 100, the pinch clip 500 includes a top prong 510 of the clipping end, a bottom prong 520 of clipping end, a hinge 530, a top extension 540 of the user gripping end, and a bottom extension 550 of the user gripping end. When the top extension 540 of the user gripping end and the bottom extension 550 of the user gripping end are pinched together, the pieces of the pinch clip 500 rotate about the hinge 530, such that the top prong 510 of the clipping end and the bottom prong 520 of clipping end extend away from each other. When the top prong 510 of the clipping end and the bottom prong 520 of clipping end are extended away from each other, an object (e.g., a section of hair) may be placed between the top prong 510 of the clipping end and the bottom prong 520 of clipping end. Then when the top extension 540 of the user gripping end and the bottom extension 550 of the user gripping end are no longer pinched together, the top prong 510 of the clipping end and the bottom prong 520 of clipping end close towards each other, and secure the object (e.g., a section of hair) between top prong 510 and bottom prong 520.

Figure 3A:
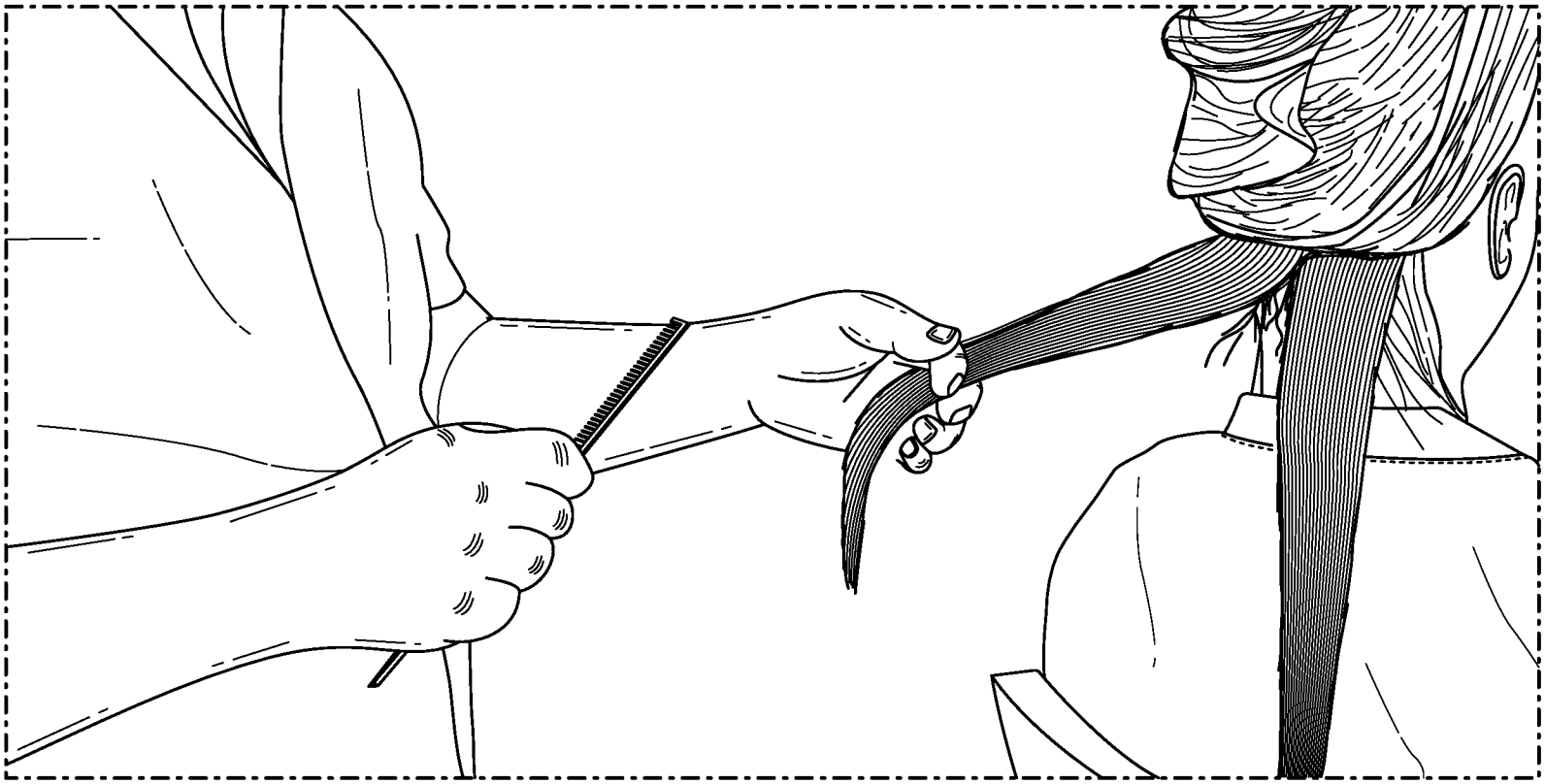
FIG. 3A PRIOR ART
FIG. 3A is a perspective view of a hair stylist that has separated out a section of a subject's hair for a prior art hair teasing method that uses "back combing."
Figure 3B:
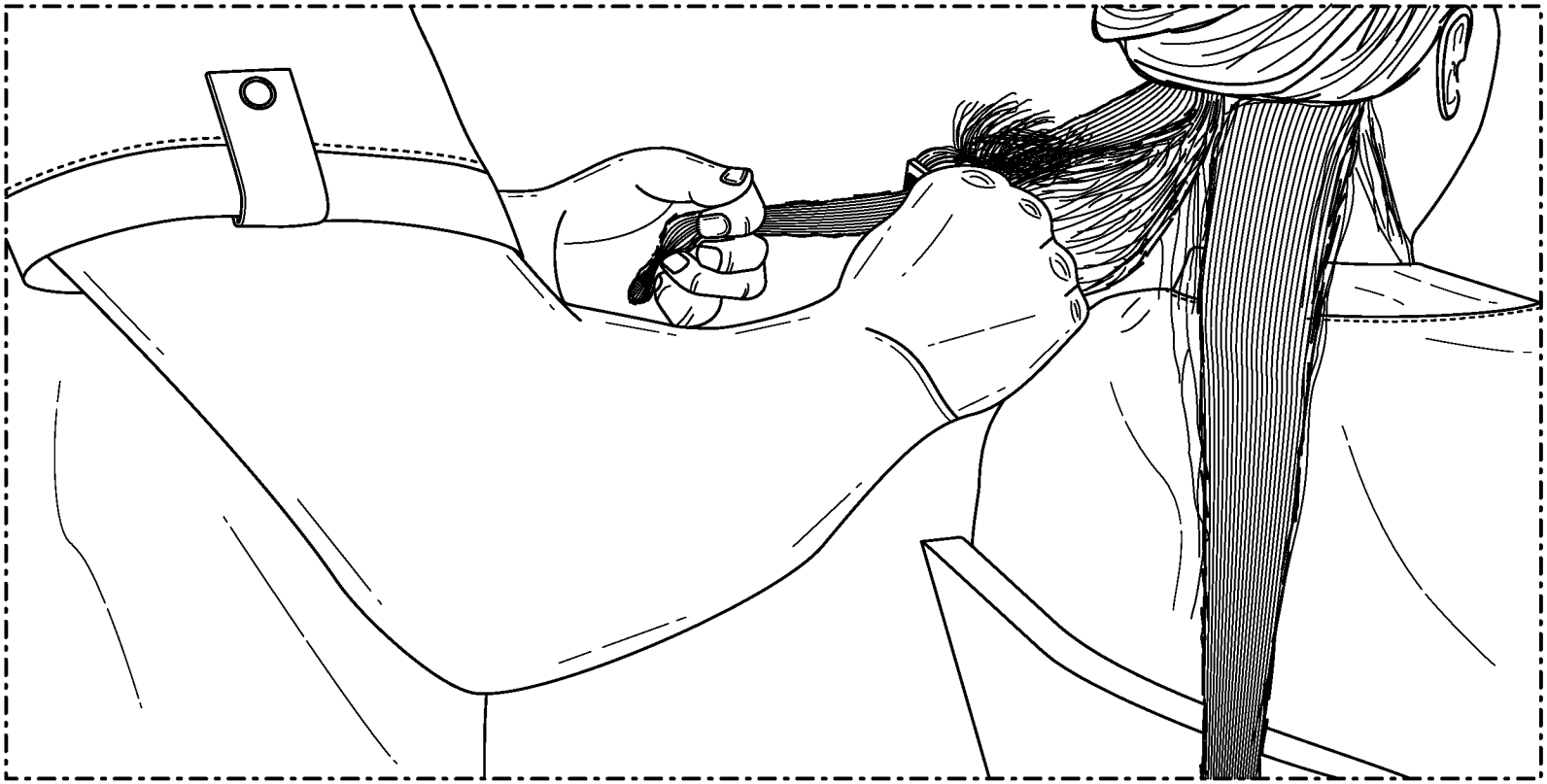
FIG. 3B PRIOR ART
FIG. 3B is a perspective view of a hair stylist that is "back combing" a separated section of the subject's hair and is damaging the hair in the prior art "back combing" hair teasing method.
Figure 3C:
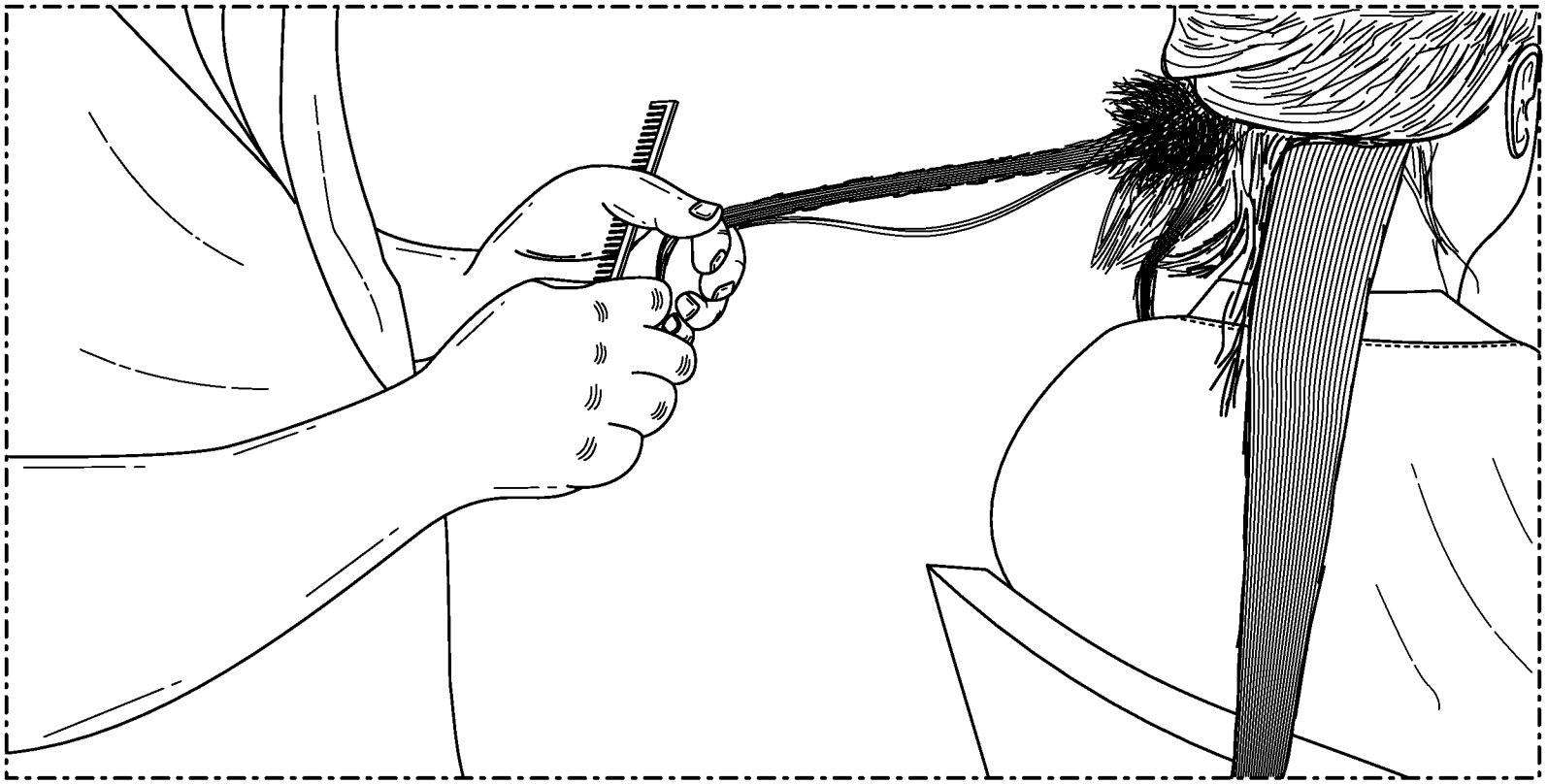
FIG. 3C PRIOR ART
FIG. 3C is a perspective view of a hair stylist that has "back combed" a separated section of the subject's hair and has bunched the damaged, clumpy, knotted hair as a result of the prior art "back combing" hair teasing method.
Figure 3D:
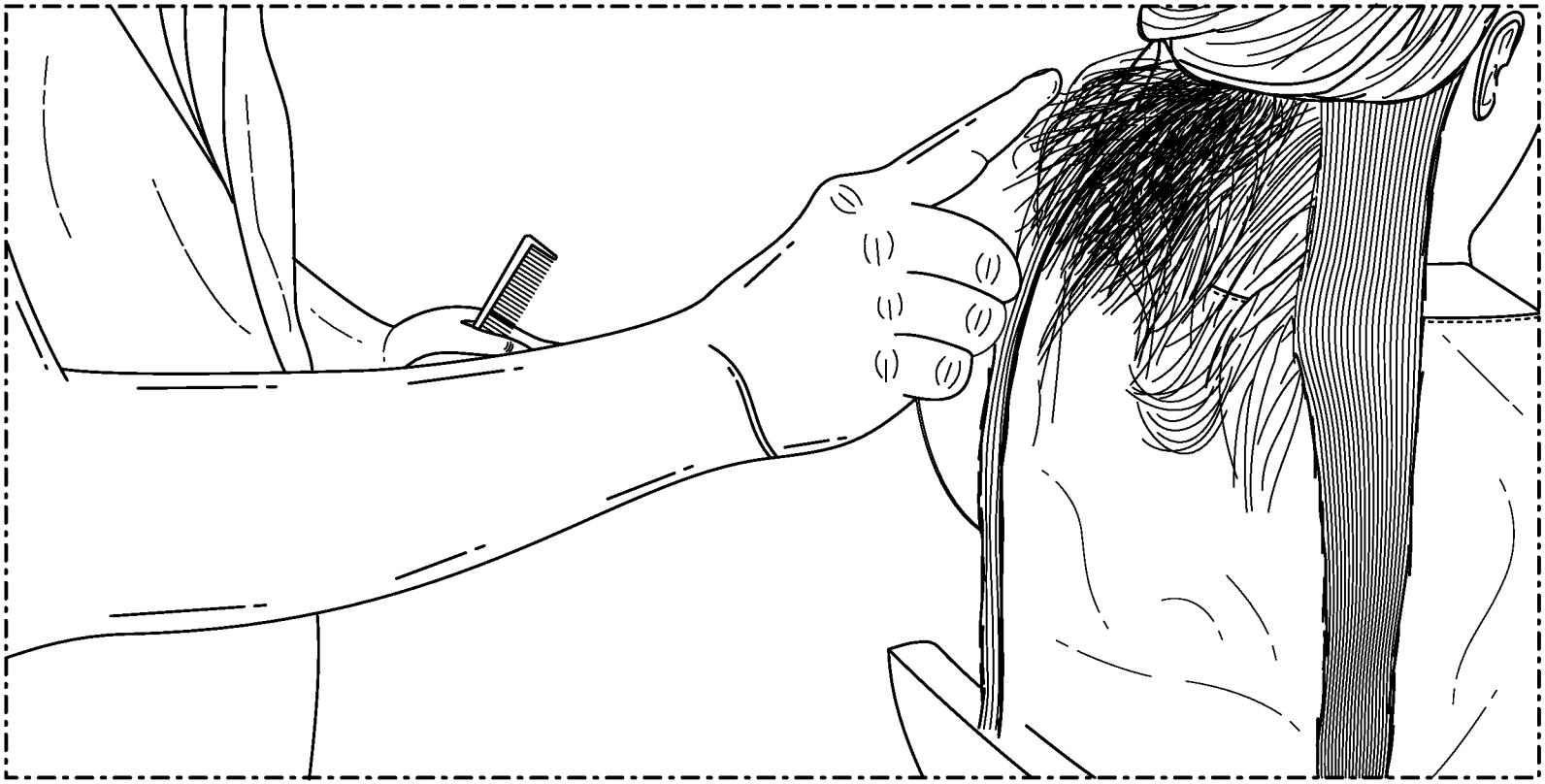
FIG. 3D PRIOR ART
FIG. 3D is a perspective view of a hair stylist that has "back combed" a separated section of the subject's hair and has bunched the damaged, clumpy, knotted hair into a "rat's nest" of tangled, damaged hair.

Referring now to FIGS. 3A-3D, prior art hair teasing technique is shown that uses "back combing." In a legacy back combing technique, a hair stylist separates out a section of hair and then combs the hair back towards the scalp while holding on to the separated section of hair. As shown in FIGS. 3B-3D, "back combing" has the significant drawback of clumping, knotting, and generally damaging the separated section of the subject's hair that is being "back combed." Specifically, FIG. 3C shows a "back combed" section of the subject's hair that has been bunched, clumped, and knotted as a result of the prior art "back combing" technique. Additionally, FIG. 3D shows a "back combed" a section of the subject's hair that has been bunched, clumped, and knotted into a "rat's nest" of tangled, damaged hair.

Figure 4:
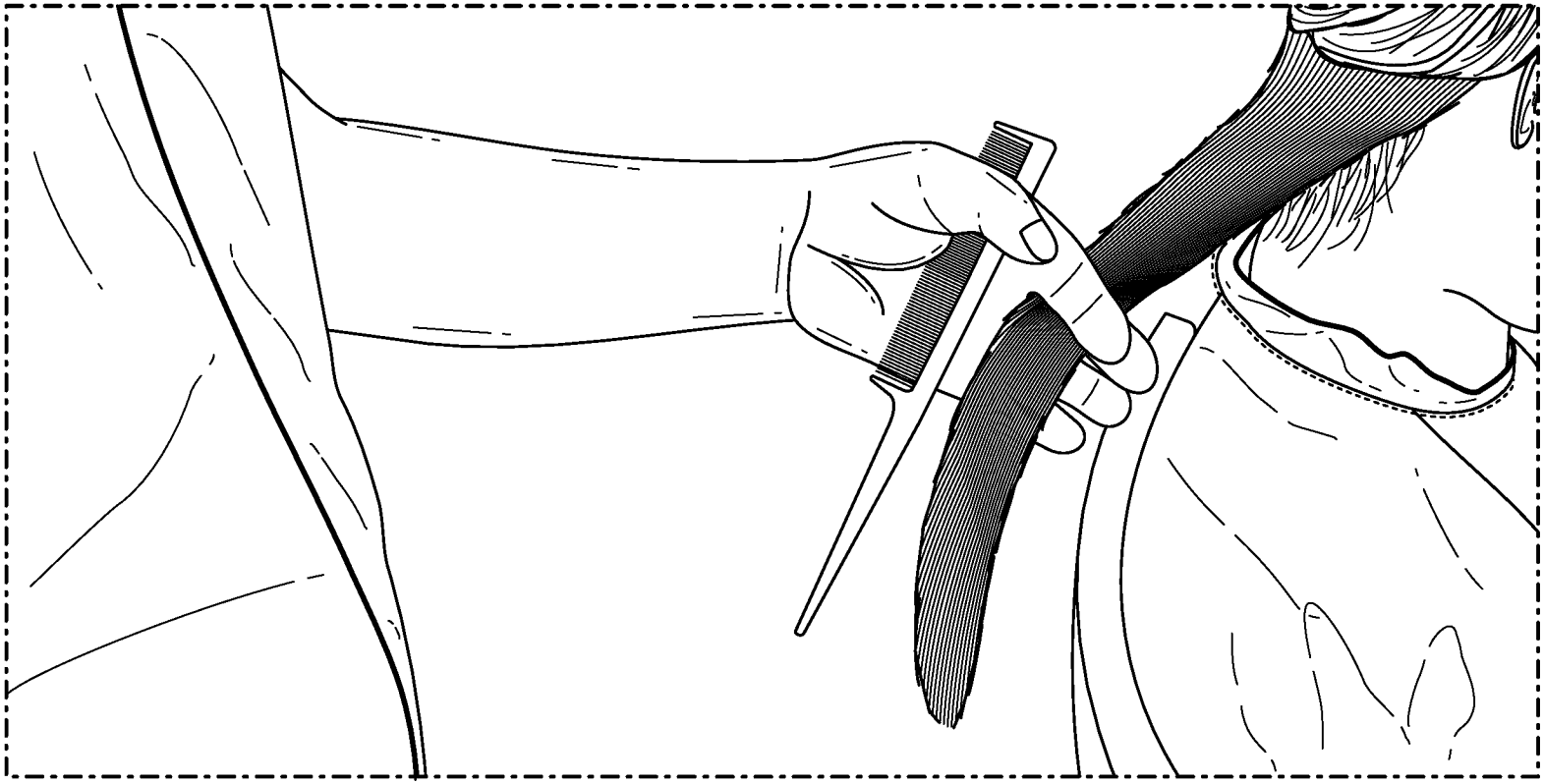
FIG. 4 is a perspective view of a hair stylist that has separated out a section of a subject's hair for an exemplary embodiment of a hair teasing and damage reduction system and method.

Referring now to FIGS. 4-11, an exemplary embodiment of the hair teasing and damage reduction system and method is shown. In FIG. 4, a hair stylist has separated out a section of a subject's hair for hair teasing using the present disclosure of the current hair teasing and damage reduction system and method 100. The hair teasing and damage reduction method provides a hair teasing system 100 that includes a sleeve 200 and a pinch clip 500. The sleeve 200 has a first half 300, a second half 400, and a middle connecting region 250. The first half 300 of the sleeve 200 includes a hair engaging surface 350 and a non-contact surface 360 with a first half pocket 340. The second half 400 of the sleeve 200 includes a hair engaging surface 450 and a non-contact surface 460 with a second half pocket 440. The pinch clip 500 has a clasping end, a gripping end, and a hinge 530. The clasping end including a top prong 510 and a bottom prong 520. The gripping end including a top extension 540 and a bottom extension 550.

Figure 5:
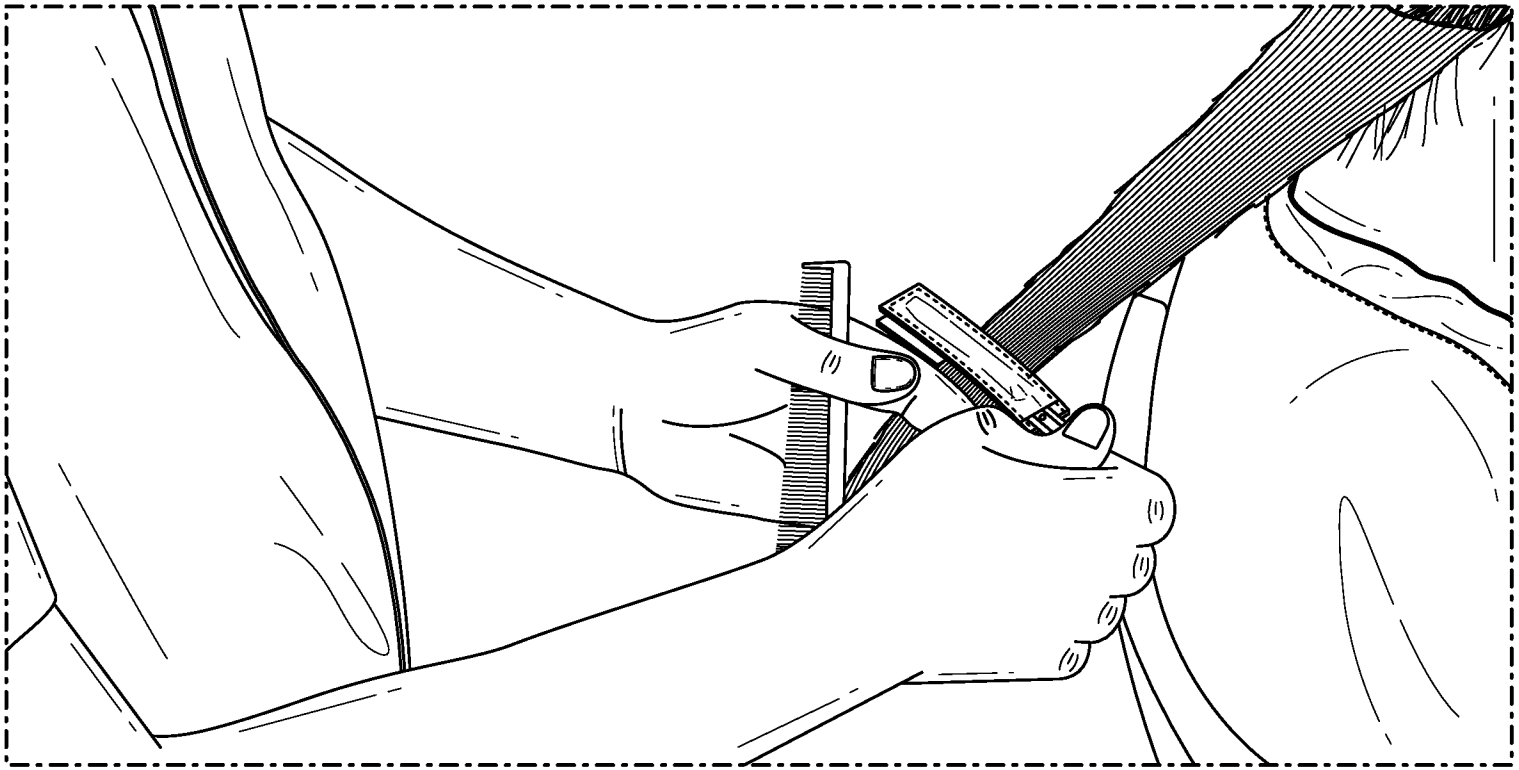
FIG. 5 is a perspective view of a hair stylist that has separated out a section of a subject's hair and placed an integrated sleeve and pinch clip over the section of hair in one exemplary embodiment of the hair teasing and damage reduction system and method.

In some embodiments, the stylist inserts the top prong 510 of the pinch clip 500 into the first half pocket 340 of the sleeve 200 and inserts the bottom prong 520 of the pinch clip 500 into the second half pocket 440 of the sleeve 200. Next, in the hair teasing and damage reduction method 100, the stylist pinches the top extension 540 and the bottom extension 550 of the gripping end of the pinch clip 500 together, which separates the top prong 510 of the pinch clip 500 with the first half pocket 340 of the sleeve 200 from the bottom prong 520 of the pinch clip 500 with the second half pocket 440 of the sleeve 200. As shown in FIG. 5, the hair stylist separates out a section of a subject's hair and places the pinched pinch clip 500 and covering sleeve 200 over the section of hair to be teased. The hair stylist then releases the pinched top extension 540 and bottom extension 550 of the gripping end of the pinch clip 500, which converges the top prong 510 of the pinch clip 500 within the first half pocket 340 of the sleeve 200 towards the bottom prong 520 of the pinch clip 500 within the second half pocket 440 of the sleeve 200 around the section of hair to be teased.

Figure 6:
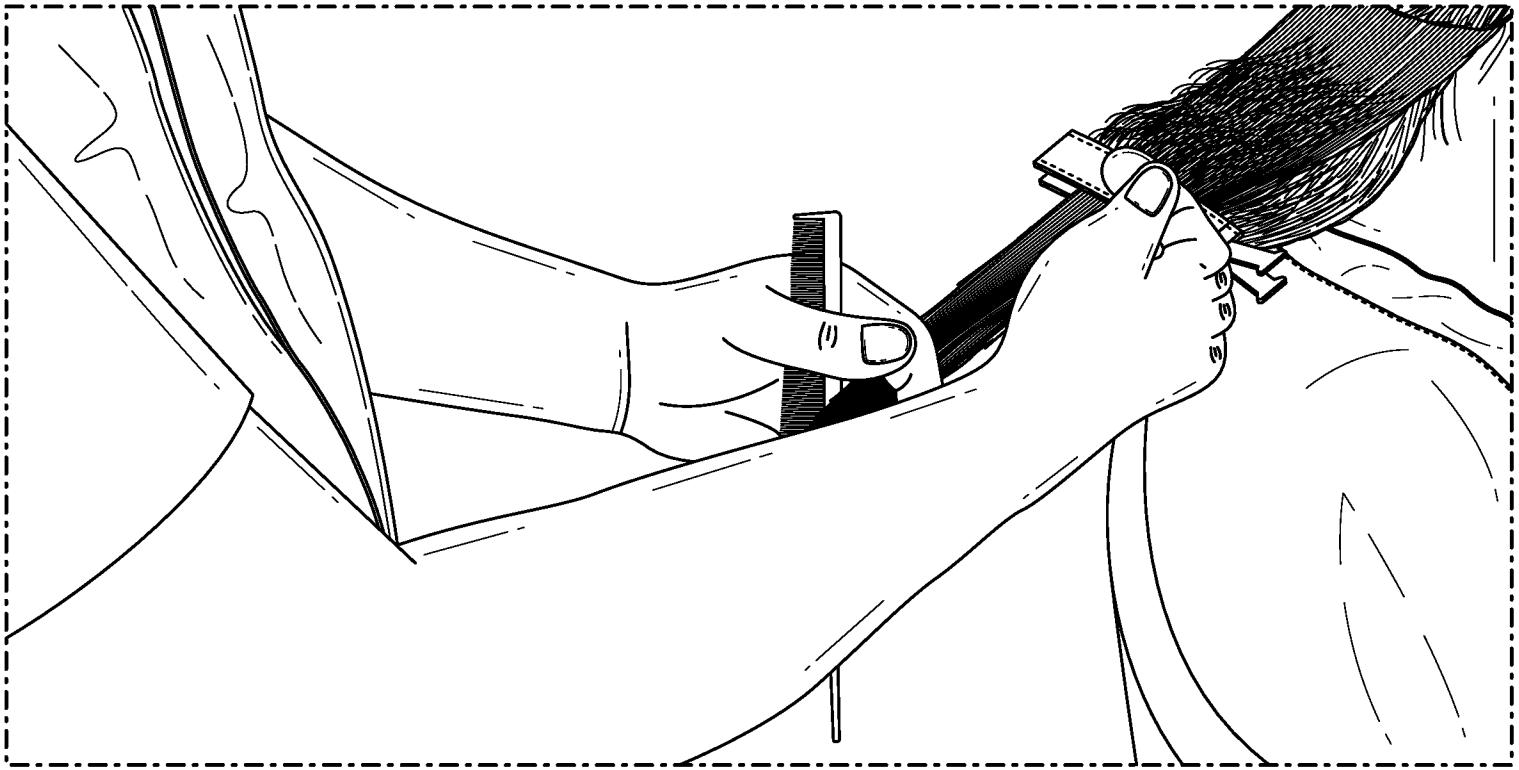
FIG. 6 is a perspective view of a hair stylist pushing the integrated sleeve and pinch clip, which has been placed over the section of hair, along the length of the subject's hair towards the roots of the subject's hair, thereby resulting in a healthy teasing of the subject's hair, in one exemplary embodiment of the hair teasing and damage reduction system and method.
Figure 7:
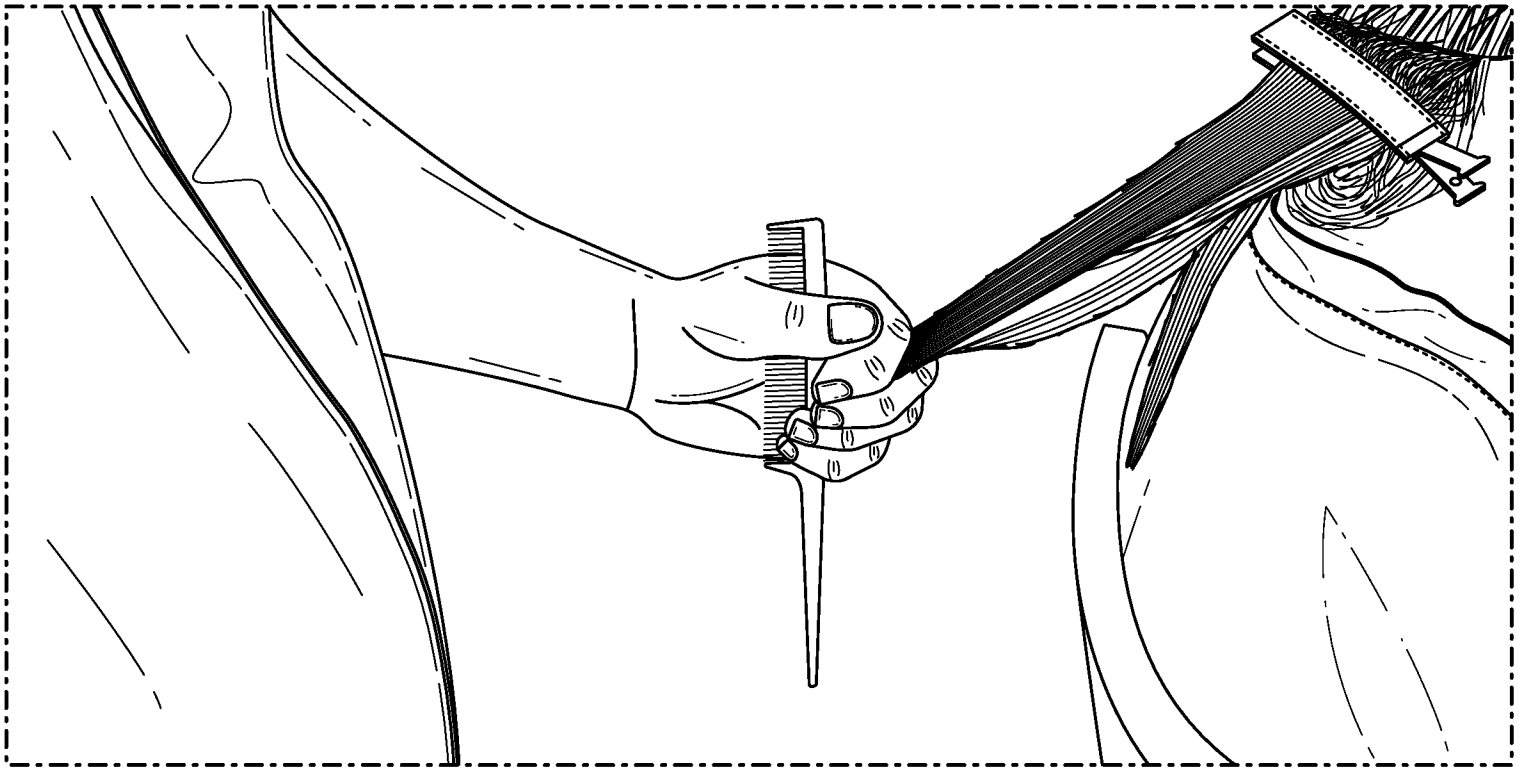
FIG. 7 is a perspective view of a hair stylist pushing the integrated sleeve and pinch clip along the length of the subject's hair almost to the roots of the subject's hair, thereby resulting in a healthy teasing of the subject's hair, in one exemplary embodiment of the hair teasing and damage reduction system and method.

Referring now to FIGS. 6 and 7, in the hair teasing and damage reduction method 100, the hair stylist pushes the integrated sleeve 200 and pinch clip 500, which has been placed over the section of hair, along the length of the subject's hair towards the roots of the subject's hair, while holding the end of the section of hair to be teased, thereby resulting in a healthy teasing of the subject's hair. Notably, the hair engaging surfaces 350 and 450 of the first half 300 and second half 400 of the sleeve 200 pushes some of the hair in the section of hair to be teased towards the head of the user while a remaining portion of the section of hair to be teased slides through the hair engaging surfaces 350 and 450 of the first half 300 and second half 400 of the sleeve 200 and is not pushed towards the head of the user.

Figure 8:
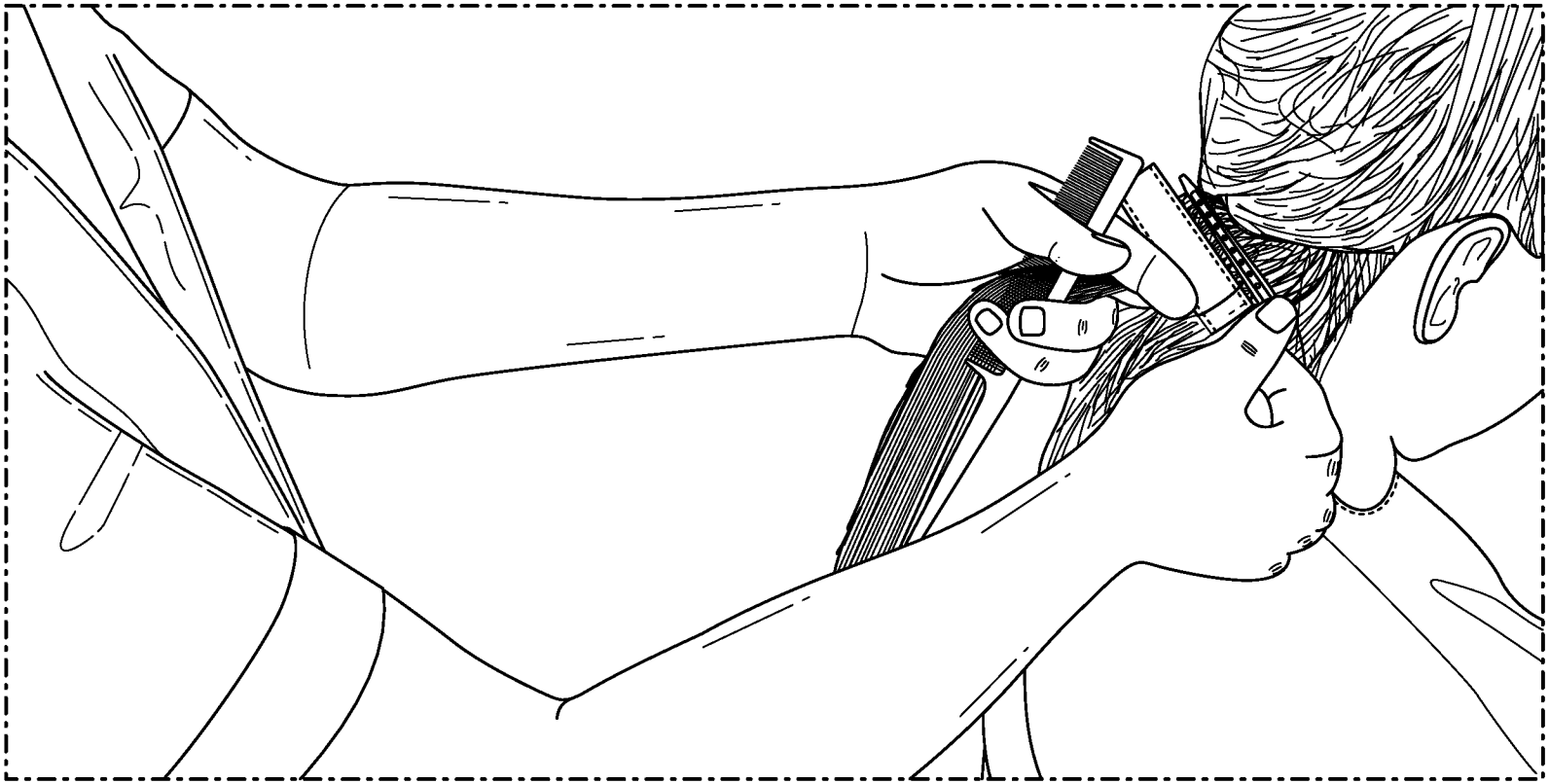
FIG. 8 is a perspective view of a hair stylist removing the pinch clip from the sleeve of the integrated sleeve and pinch clip, and placing the pinch clip over the section of the subject's hair near the roots of the subject's hair, in one exemplary embodiment of the hair teasing and damage reduction system and method.

As shown in FIG. 8, in the hair teasing and damage reduction method 100, the hair stylist then slidably removes the top prong 510 of the pinch clip 500 from the first half pocket 340 of the sleeve 200 and slidably removes the bottom prong 520 of the pinch clip 500 from the second half pocket 440 of the sleeve 200, while maintaining the hair engaging surfaces 350 and 450 of the first half 300 and second half 400 of the sleeve 200 in contact with the section of hair to be teased. To slidably remove the top prong 510 and bottom prong 520 of the pinch clip 500 from the first half pocket 340 and second half pocket 440 of the sleeve 200, the hair stylist slightly pinches the top extension 540 and the bottom extension 550 of the gripping end of the pinch clip 500 together and then retracts the pinch clip 500. Continuing in the hair teasing and damage reduction method 100, the hair stylist then places the pinch clip 500 over the section of the subject's hair near the roots of the subject's hair (i.e., places the top prong 510 of the pinch clip 500 over the section of hair and places the bottom prong 520 of the pinch clip 500 under the section of hair). The hair stylist then releases the pinched top extension 540 and bottom extension 550 of the gripping end of the pinch clip 500, which converges the top prong 510 of the pinch clip 500 towards the bottom prong 520 of the pinch clip 500 around the section of hair to be teased on the user.

Figure 9:
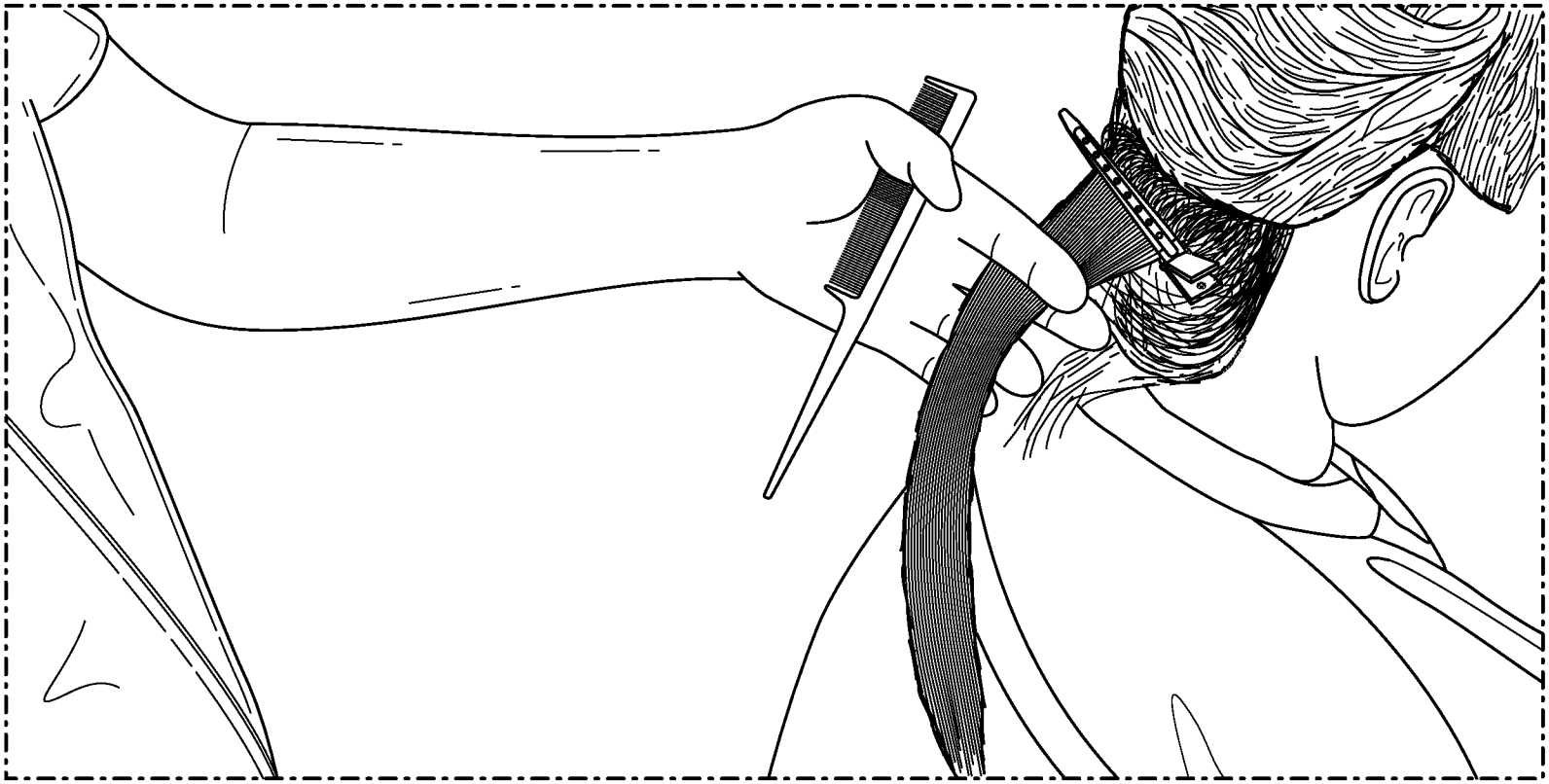
FIG. 9 is a perspective view of a hair stylist having placed the pinch clip over the section of the subject's hair near the roots of the subject's hair and having removed the sleeve from the section of the subject's hair, in one exemplary embodiment of the hair teasing and damage reduction system and method.
Figure 10:
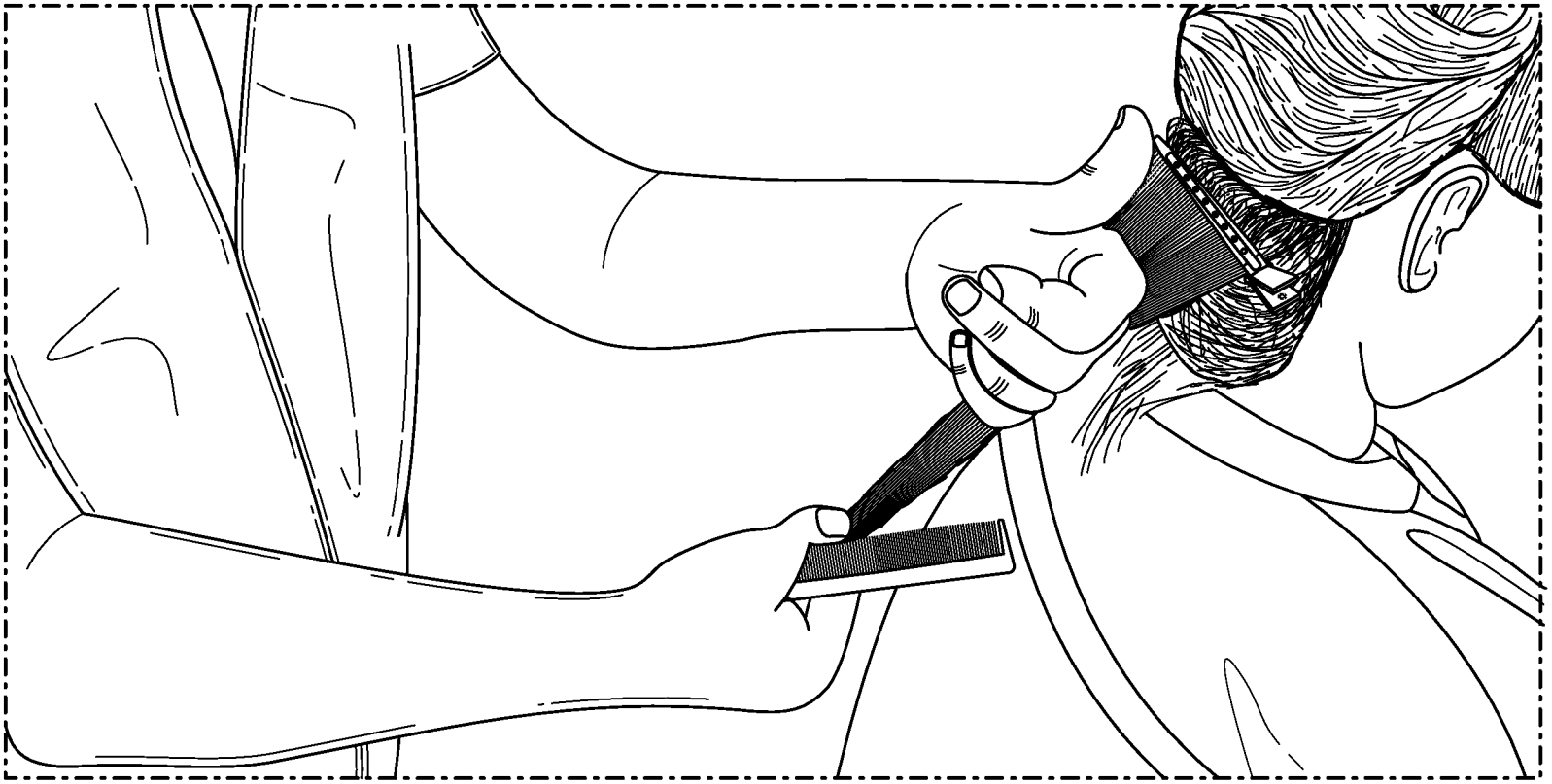
FIG. 10 is a perspective view of a satisfied hair stylist that placed the pinch clip over the section of the subject's hair near the roots of the subject's hair and removed the sleeve from the section of the subject's hair, in one exemplary embodiment of the hair teasing and damage reduction system and method.
Figure 11:
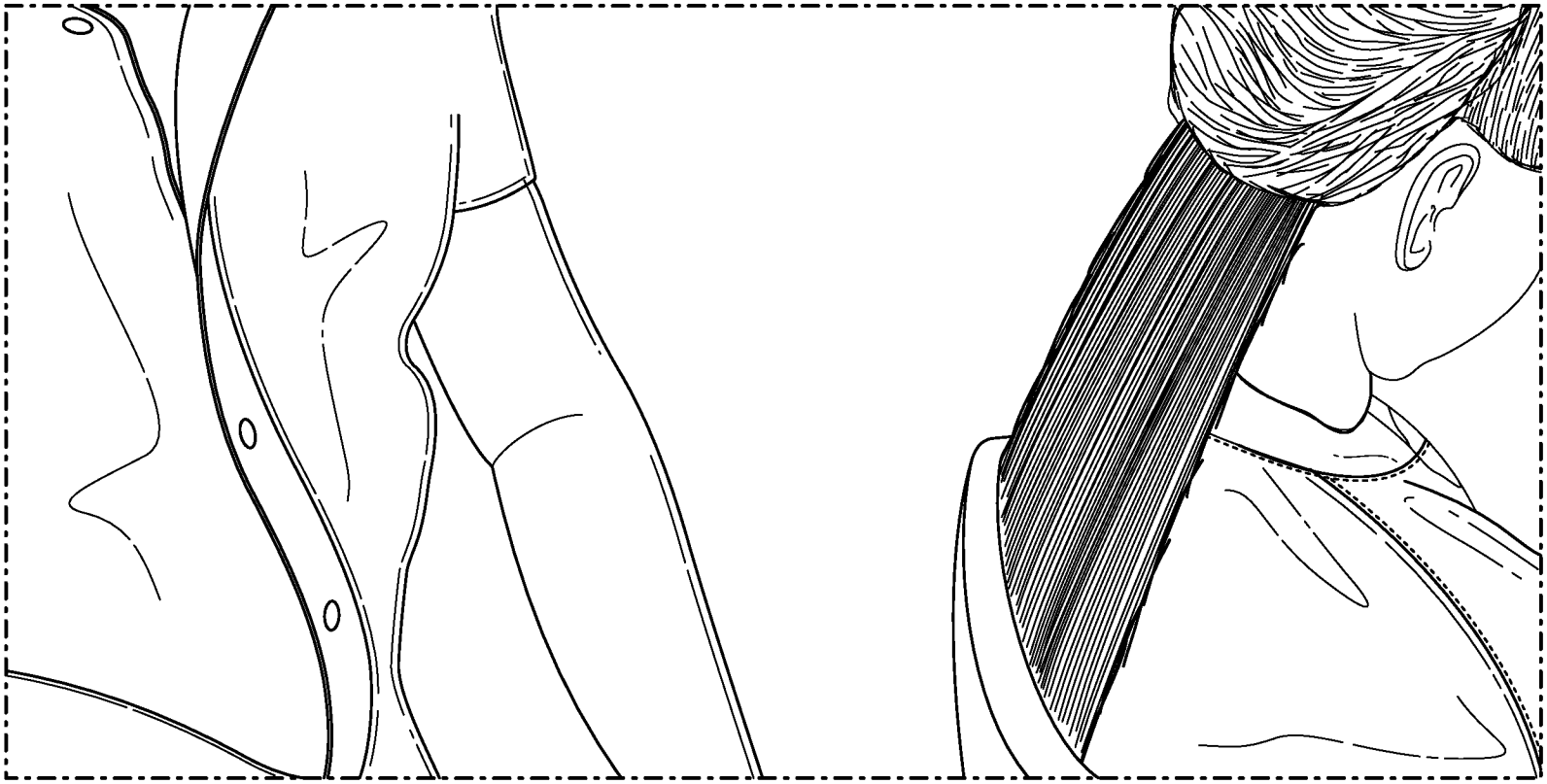
FIG. 11 is a perspective view of hair stylist showing that the subject's hair has not been damaged by the hair teasing technique of the current hair teasing and damage reduction system and method.

Referring now to FIGS. 9 and 10, in the hair teasing and damage reduction method 100, the hair stylist places the pinch clip 500 over the section of the subject's hair near the roots of the subject's hair and removes the sleeve 200 from the section of the subject's hair. As shown in FIG. 11, the subject's hair has not been damaged by the hair teasing technique of the current hair teasing and damage reduction system and method. Thus, the hair teasing and damage reduction system and method 100 is dramatically faster than conventional hair teasing techniques, and is also far less damaging to the hair.

Figure 12B:
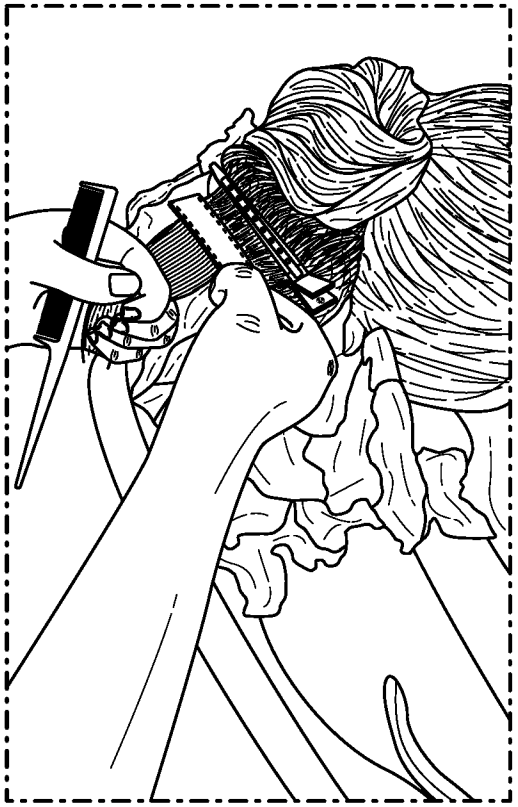
FIG. 12B is a perspective view of a balayage hair dyeing process in which a hair stylist is pushing the integrated sleeve and pinch clip, which has been placed over the section of hair, along the length of the subject's hair towards the roots of the subject's hair, thereby resulting in a healthy teasing of the subject's hair, in one exemplary embodiment of the hair teasing and damage reduction system and method.
Figure 12A:
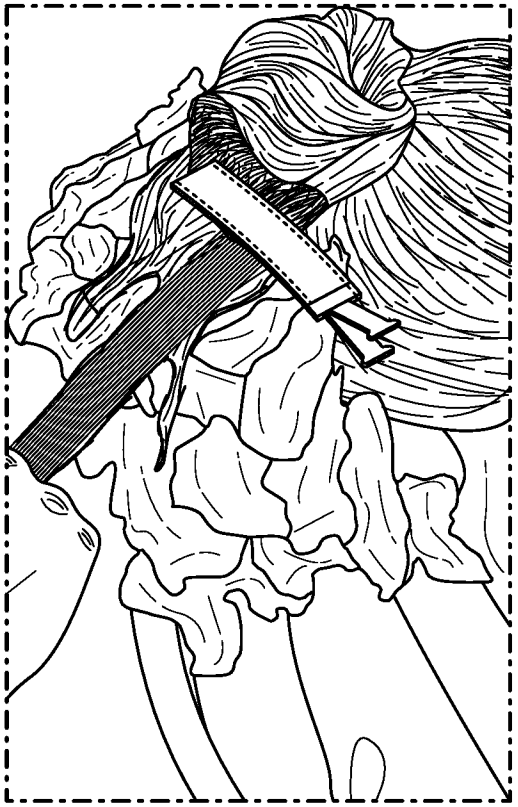
FIG. 12A is a perspective view of a balayage hair dyeing process in which a hair stylist has separated out a section of a subject's hair and placed an integrated sleeve and pinch clip over the section of hair in one exemplary embodiment of the hair teasing and damage reduction system and method.
Figure 12D:
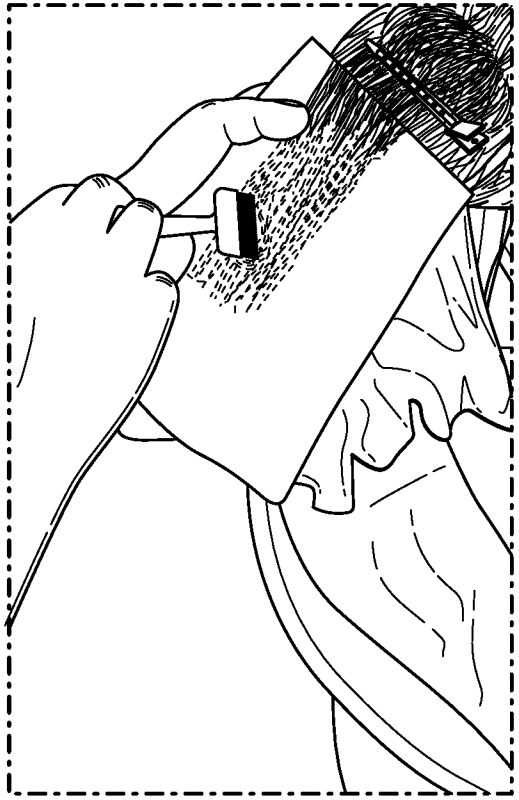
FIG. 12D is a perspective view of a balayage hair dyeing process in which a hair stylist has placed the pinch clip over the section of the subject's hair near the roots of the subject's hair, has removed the sleeve from the section of the subject's hair, and is applying hair dye to a portion of the subject's hair over foil, in one exemplary embodiment of the hair teasing and damage reduction system and method.
Figure 12C:
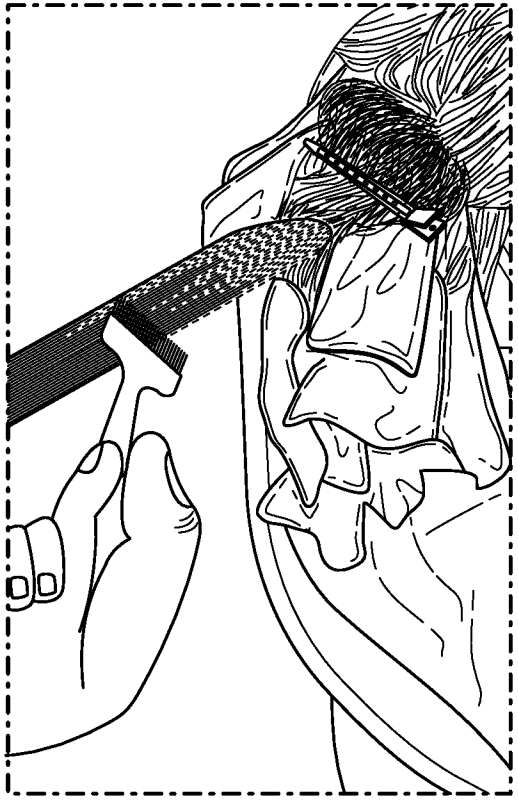
FIG. 12C is a perspective view of a balayage hair dyeing process in which a hair stylist has placed the pinch clip over the section of the subject's hair near the roots of the subject's hair, has removed the sleeve from the section of the subject's hair, and is applying hair dye to a portion of the subject's hair, in one exemplary embodiment of the hair teasing and damage reduction system and method.
Figure 12E:
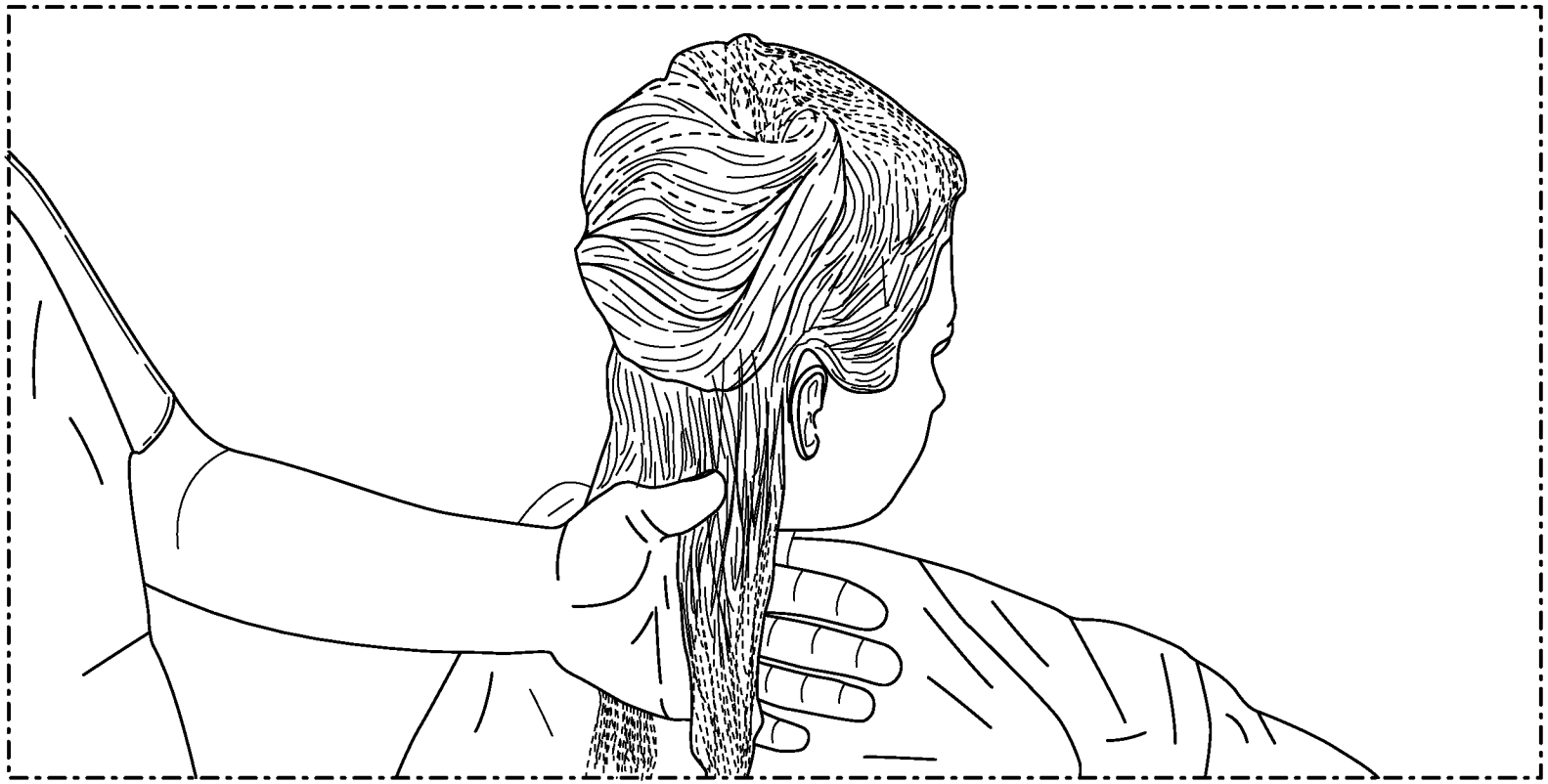
FIG. 12E is a perspective view of a completed balayage hair dyeing process, in one exemplary embodiment of the hair teasing and damage reduction system and method.

Referring now to FIGS. 12A-12E, an example of a balayage hair dyeing process is shown that incorporates the current hair teasing and damage reduction system and method. FIG. 12A shows a hair stylist that has separated out a section of a subject's hair and placed an integrated sleeve 200 and pinch clip 500 over the section of hair. FIG. 12B shows a hair stylist that is pushing the integrated sleeve 200 and pinch clip 500, which has been placed over the section of hair, along the length of the subject's hair towards the roots of the subject's hair, thereby resulting in a healthy teasing of the subject's hair. FIG. 12C shows a hair stylist that has placed the pinch clip 500 over the section of the subject's hair near the roots of the subject's hair, has removed the sleeve 200 from the section of the subject's hair. Additionally, the hair stylist is applying hair dye to a portion of the subject's hair. FIG. 12D also shows a hair stylist that has placed the pinch clip 500 over the section of the subject's hair near the roots of the subject's hair, has removed the sleeve 200 from the section of the subject's hair. Further, the hair stylist is applying hair dye to a portion of the subject's hair over foil. Finally, in FIG. 12E, a completed balayage hair dyeing process is shown that incorporated the hair teasing and damage reduction system and method.

In some other embodiments, the hair teasing and damage reduction system 100 includes a sleeve 200 having a first half 300, a second half 400, and a middle connecting region 250. The first half 300 of the sleeve 200 includes a hair engaging surface 350 and a non-contact surface 360 with a pocket 340 formed by a left lateral edge 310, a right lateral edge 320, and an end edge 330. The second half of the sleeve includes a hair engaging surface 450 and a non-contact surface 460 with a pocket 440 formed by a left lateral edge 410, a right lateral edge 420, and an end edge 430.

In these embodiments as well, the hair engaging surface 350 of the first half 300 of the sleeve 200 has a textured surface that grips at least some of a subject's hair when the hair engaging surface 350 is pushed against a section of hair and then moved in sliding contact along the section of hair towards the roots of the hair in the section. In some embodiments, the textured surface of the hair engaging surface 350 of the first half 300 of the sleeve 200 is the "hook" side of a "hook and loop" fastener (e.g., Velcro). In other embodiments, the textured surface of the hair engaging surface 350 of the first half 300 of the sleeve 200 may be other rough or coarse surfaces (e.g., ribs, pointed bumps, rounded bumps, flat-topped bumps, and the like) of a rubber, plastic, or other appropriate material that has a coefficient of friction sufficiently high enough to grip at least some of a section of hair when in sliding contact with the section of hair. In some other embodiments, the non-contact surface 360 of the first half 300 of the sleeve 200 may be of any texture, since this non-contact surface 360 of the first half 300 of the sleeve 200 is not designed to make gripping contact with the subject's hair.

In another aspect of some embodiments, the hair teasing and damage reduction system 100 is used in conjunction with a top prong and a bottom prong of a pinch clip, which is slidably insertable into the pocket of the first half of the sleeve and pocket of the second half of the sleeve, and slidably removable from the pocket of the first half of the sleeve and pocket of the second half of the sleeve, thereby enabling the pinch clip to be housed partially within the sleeve to grip a section of hair.

In still another aspect of some embodiments, the hair teasing and damage reduction system 100 comprises the sleeve 200, and the sleeve 200 is used without a corresponding pinch clip. In such an embodiment, the sleeve 200 may be folded outward so that the hair engaging surfaces 350 and 360 form a V-shape or even a flattened line with the hair engaging surfaces 350 and 360 each bent at 90 degrees from the middle connecting region 250. In this regard, the middle connecting region 250 is comprised of a material that is bendable, and that holds its shape after being bent, such as from flat to a 90 degree angle. In such a configuration, the hair engaging surfaces 350 and 360 of the sleeve 200 may be stroked against a section of hair of a subject, towards the head of the subject while a section of the subject's hair is held extended by the user of the hair teasing and damage reduction system 100. This stroking of extended sections of hair may be repeated until a desired level of hair teasing is achieved using the sleeve 200 of the hair teasing and damage reduction system 100 with the hair engaging surfaces 350 and 360 folded outward.

Certain words and phrases used in the specification are set forth as follows. As used throughout this document, including the claims, the singular form "a", "an", and "the" include plural references unless indicated otherwise. Any of the features and elements described herein may be singular, e.g., a sensor may refer to one sensor and a memory may refer to one memory. The terms "include" and "comprise," as well as derivatives thereof, mean inclusion without limitation. The term "or," is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Other definitions of certain words and phrases are provided throughout this patent document.

Where a range of values is provided, it is understood that each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the present disclosure.

The foregoing description, for purposes of explanation, uses specific nomenclature and formula to provide a thorough understanding of the disclosed embodiments. It should be apparent to those of skill in the art that the specific details are not required in order to practice the invention. The embodiments have been chosen and described to best explain the principles of the disclosed embodiments and its practical application, thereby enabling others of skill in the art to utilize the disclosed embodiments, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the breadth and scope of a disclosed embodiment should not be limited by any of the above-described exemplary embodiments, but should be defined only in accordance with the following claims and their equivalents.

The invention claimed is:

1. A hair teasing and damage reduction method, the method comprising:

providing a hair teasing system, the hair teasing system including a double-ended sleeve and a pinch clip, the double-ended sleeve having a first half on a first end of the double-ended sleeve, a second half on a second end of the double-ended sleeve, a second half on a second end of the double-ended sleeve, and a middle connecting region, wherein the first end of the double-ended sleeve away from the middle connecting region and the second end of the double-ended sleeve away from the middle connecting region are not connected to each other, the first half and the second half configured to fold across a small length portion of a section of a customer's hair to be teased;

wherein the first half of the double-ended sleeve includes a hair engaging surface and a non-contact surface with a first half pocket formed by a left lateral edge, a right lateral edge, and an end edge, and wherein the second half of the double-ended sleeve includes a hair engaging surface and a non-contact surface with a second half pocket formed by a left lateral edge, a right lateral edge, and an end edge, the pinch clip that holds the customer's hair in place having a clasping end, a gripping end, and a hinge, the clasping end including a top prong and a bottom prong, and the gripping end including a top extension and a bottom extension;

inserting the top prong of the pinch clip into the first half pocket of the double-ended sleeve and inserting the bottom prong of the pinch clip into the second half pocket of the double-ended sleeve;

pinching the top extension and the bottom extension of the gripping end of the pinch clip together and separating the top prong of the pinch clip with the first half pocket of the double-ended sleeve from the bottom prong of the pinch clip with the second half pocket of the double-ended sleeve;

placing the pinched pinch clip and covering double-ended sleeve over a section of the customer's hair to be teased;

releasing the pinched top extension and bottom extension of the gripping end of the pinch clip, which converges the top prong of the pinch clip within the first half pocket of the double-ended sleeve towards the bottom prong of the pinch clip within the second half pocket of the double-ended sleeve around the section of the customer's hair to be teased;

teasing the section of the customer's hair by pushing the hair teasing system griping the section of hair to be teased towards the head of the customer's head while holding the end of the section of hair to be teased, wherein the hair engaging surfaces of the first and second halves of the double-ended sleeve pushes some of the section of the customer's hair to be teased towards the customer's head while a remaining portion of the section of customer's hair to be teased slides through the hair engaging surfaces of the first and second halves of the double-ended sleeve and is not pushed towards the customer's head;

slidably removing the top prong of the pinch clip from the first half pocket of the double-ended sleeve and slidably removing the bottom prong of the pinch clip from the second half pocket of the double-ended sleeve, while maintaining the hair engaging surfaces of the first and second halves of the double-ended sleeves in contact with the section of the customer's hair to be teased;

pinching the top extension and the bottom extension of the gripping end of the pinch clip together and separating the top prong of the pinch clip from the bottom prong of the pinch clip; and releasing the pinched top extension and bottom extension of the gripping end of the pinch clip, which converges the top prong of the pinch clip towards the bottom prong of the pinch clip around the section of the customer's hair to be teased.

2. The hair teasing and damage reduction method of claim 1, wherein the pocket first half of the double-ended sleeve is formed by a left lateral edge, a right lateral edge, and an end edge.

3. The hair teasing and damage reduction method of claim 1, wherein the pocket second half of the double-ended sleeve is formed by a left lateral edge, a right lateral edge, and an end edge.

4. The hair teasing and damage reduction method of claim 1, wherein a left lateral edge is stitched.

5. The hair teasing and damage reduction method of claim 1, wherein a right lateral edge is stitched.

6. The hair teasing and damage reduction method of claim 1, wherein an end edge is stitched.

7. The hair teasing and damage reduction method of claim 1, wherein the pinch clip is an Alligator Pinch Clip.

8. The hair teasing and damage reduction method of claim 1, wherein the double-ended sleeve is constructed of a material with sufficient flexibility to move in conjunction with the pinch clip.

9. The hair teasing and damage reduction method of claim 1, wherein the pocket formed by a left lateral edge, a right lateral edge, and an end edge houses the clasping ends of the top prong and bottom prong.

10. The hair teasing and damage reduction method of claim 1, wherein the pocket formed by the left lateral edge, right lateral edge, and end edge houses at least a portion of the clasping ends of the top prong and bottom prong.

11. The hair teasing and damage reduction method of claim 1, wherein the hair engaging surfaces of the first and second halves of the double-ended sleeve have a textured surface with a co-efficient of friction that grips and holds some, but not all, of the small length portion of the section of the customer's hair to be teased that is positioned between the hair engaging surfaces by folding the first half and the second half of the double-ended sleeve across the small length portion and clamping the pinch clip positioned in the pockets of the double-ended sleeve, and wherein the double-ended sleeve is slid along the length of the section of the customer's hair towards roots of the customer's hair in the section.

* * * * *